United States Patent [19]

Liddell et al.

[11] Patent Number: 4,754,576

[45] Date of Patent: Jul. 5, 1988

[54] OPTICAL FIBRE GRINDER

[75] Inventors: William J. Liddell, Harrow; Alan E. Green, Uxbridge; Cyril W. Coe, Edgware, all of England

[73] Assignee: The General Electric Company, p.l.c., England

[21] Appl. No.: 941,053

[22] Filed: Dec. 12, 1986

[30] Foreign Application Priority Data

Dec. 13, 1985 [GB] United Kingdom ..... 8530717

[51] Int. Cl.[4] ..... B24B 49/12

[52] U.S. Cl. ..... 51/165.72; 51/131.1

[58] Field of Search ..... 51/165.72, 131.1

[56] References Cited

U.S. PATENT DOCUMENTS

| | | | |
|---|---|---|---|
| 1,419,140 | 6/1922 | Hutchinson | 51/131.1 |
| 2,576,333 | 11/1951 | Earll | 51/131.1 |
| 2,655,768 | 10/1953 | Bartell | 51/131.1 |
| 2,821,051 | 1/1958 | Franz | 51/124 |
| 3,082,581 | 3/1963 | Vadeboncoeur | 51/165.72 |
| 3,650,075 | 3/1972 | Mason | 51/165.72 |
| 3,975,865 | 8/1976 | Lewis | 51/170 |

FOREIGN PATENT DOCUMENTS

| | | |
|---|---|---|
| 1200171 | 7/1970 | United Kingdom . |
| 2057932 | 4/1981 | United Kingdom . |

OTHER PUBLICATIONS

"Optimisation of the Coupling Efficiency Between a Semiconductor Laser and a Monomode Optical Fibre", by G. Georgiou, GEC Research Laboratories, U.K., SPIE, vol. 374.

*Primary Examiner*—Harold D. Whitehead

*Attorney, Agent, or Firm*—Kirschstein, Kirschstein, Ottinger & Israel

[57] ABSTRACT

A grinding device for grinding the ends of fibres and particularly optical fibres comprises a stand 10 carrying a mounting arrangement 13 for mounting a fibre and rotating it about its longitudinal axis. The stand 10 also carries a grinding wheel 18 and a microscope 22. The positions of the microscope 22 and mounting arrangement are all accurately controllable by micrometers 12, 23, 25 and 27.

4 Claims, 2 Drawing Sheets

OPTICAL FIBRE GRINDER

BACKGROUND OF THE INVENTION

1. Field of the Invention

The present invention concerns a device for tapering the ends of small diameter elements or fibres, and in particular monomode optical fibres.

2. Description of Related Art

When making connections between a monomode optical fibre and other circuit elements for input or output purposes an accurate taper has to be provided on the end of the fibre. This is done to reduce the end diameter of the fibre to a specified value so that, in a known manner, it can be heated to form a lens.

For small batches of monomode fibres this has been done by holding the fibre tip against a grinding wheel and intermittently inspecting the result. This, besides being laborious and time consuming, leads to a high reject rate.

SUMMARY OF THE INVENTION

The present invention has for an object to provide a simple and inexpensive device for grinding tapers into the ends of fibres which reduces the above disadvantages.

Accordingly the present invention consists in a grinding device comprising a driven grinding surface, means for holding a fibre or filament so that an end thereof can contact the grinding surface, means for imparting rotation about its longitudinal axis to a fibre or filament so held, a microscope mounted so that the end of the fibre or filament can be viewed whilst a grinding operation is in progress, and micrometer means for adjusting the relative position of the holding means and the microscope.

Preferably the microscope is adjustable in all three axes relative to the grinding surface. The grinding surface may be a wheel of durable resinoid bonded diamond.

BRIEF DESCRIPTION OF THE DRAWINGS

In order that the invention may be more readily understood, an embodiment thereof will now be described by way of example and with reference to the accompanying drawings, in which.

DETAILED DESCRIPTION OF THE PREFERRED EMBODIMENTS

Figure 1:
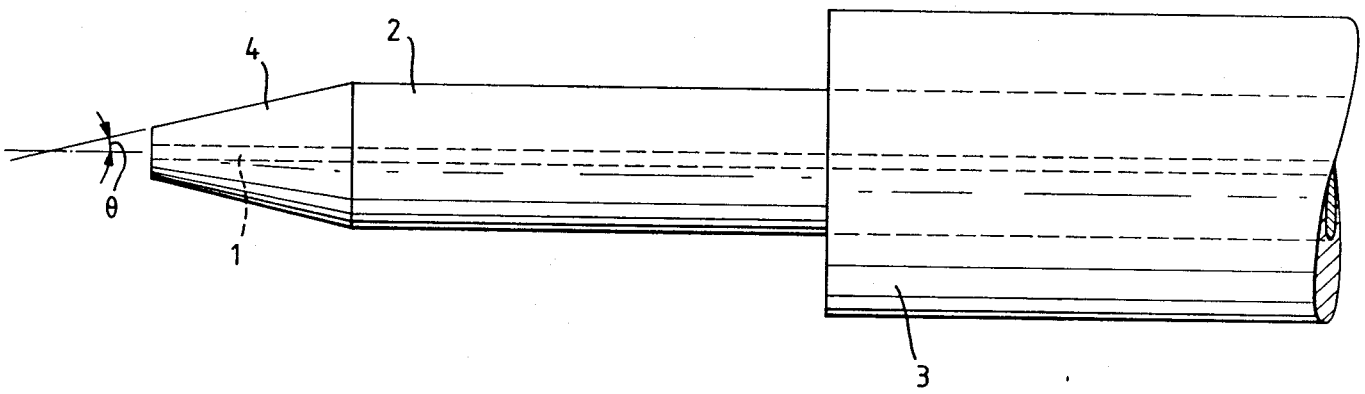
FIG. 1 is a side view of a tapered end of a monomode optical fibre.

Referring now to the drawings a tapered end of an optical fibre as shown in FIG. 1 comprises a core 1 with a typical diameter of 9 μm, a cladding layer 2 with a typical diameter of 125 μm and an outer primary coating 3. In order to make a connection with other circuit elements such as light-emitting diodes or detectors the primary coating 3 has been stripped and cleaned and the cladding 2 ground into a taper 4. The tapering has to be done extremely accurately to ensure that the tapered end has an exact diameter. It is then normal prcatice to heat the end diameter so that it forms a curved lens.

Figure 2:
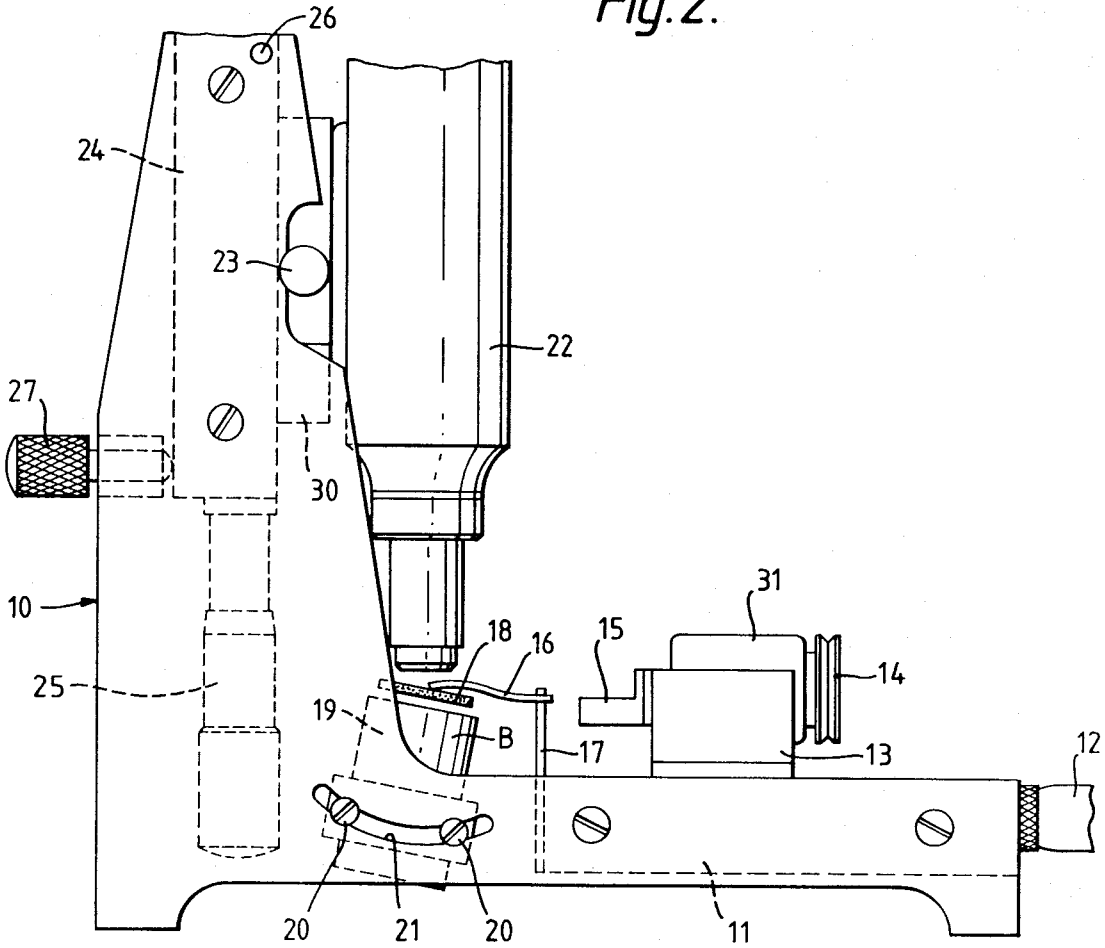
FIG. 2 is a similar view of a device for tapering filaments or fibres.

Referring now to FIG. 2 of the drawings this shows a device for grinding the ends of fibres or filaments, and particularly monomode optical fibres comprising a substantially L-shaped stand 10 carrying a horizontal slide 11 the position of which can be accurately controlled by a Vernier micrometer partially shown at 12. The slide 11 carries an electric motor 31 located behind a mounting arrangement 13 which includes a pulley 14 and a clamp mechanism 15. An optical fibre the end of which is to be tapered is passed through an axial bore in pulley 14, through the mounting arrangement 13, where it is held by the clamp mechanism 15, and into a tubular ferrule 16 mounted on a post 17. In operation the fibre to be ground is passed through the ferrule 16 until it engages a grinding wheel 18. The latter is driven by an electric motor 19 mounted by bolts 20 in an arcuate slot 21 so that the angle of the grinding wheel can be altered. The grinding wheel 18 has a grinding surface which is of resinoid bonded diamond.

The upright limb of stand 10 carries a ×400 magnification, self-illuminating refracting microscope 22 the position of which can be accurately set in all three axes. Firstly microscope 22 is mounted so that it can be moved transversely with respect to the general longitudinal axis of the fibre to be tapered. This is done by means of another Vernier micrometer shown at 23 acting on a plate 30 located in guides. The guides for this sideways movement are carried in a plate 24 capable of sliding vertically under the control of a further Vernier micrometer 25. This whole assembly is pivoted to the upwardly extending limb of stand 10 at 26 so that the microscope and slides can be pivoted about 26 by a final Vernier micrometer 27.

The two electric motors of the device and the light source of microscope 22 all take their power from a single, standard 6 volt source. The device as described is thus easily portable. The operation of the two electric motors is controlled by ordinary switches in the base of stand 10.

It will be appreciated that the device just described is relatively simple to use. Once a fibre has been passed through the ferrule 16 the position of the end to be ground can be accurately set with respect to grinding wheel 18 by means of the micrometer 12. The microscope 22 can also be ideally positioned with respect to the fibre end by means of its associated micrometers. Thus a grinding operation can be monitored from beginning to end and the magnification of the microscope 22 is such that, given an appropriate scale in it optical system, an exact ground end diameter can be achieved.

We claim:

1. A grinding device for grinding the ends of optical fibres, comprising:

(a) a grinding wheel;

(b) means for rotating the grinding wheel;

(c) means for mounting an optical fibre to be ground;

(d) means for rotating said mounting means whereby a mounted optical fibre is rotated about its longitudinal axis;

(e) a base member on which said grinding wheel and said fibre mounting means are mounted;

(f) a supporting limb extending from said base member;

(g) a first plate pivotally connected to said limb;

(h) a second plate slidably mounted in said first plate for relative movement toward and away from said base member;

(i) a third plate slidably mounted on said second plate for movement at right angles to the movement of said second plate;

(j) a microscope mounted on said third plate whereby a user can view the end of an optical fibre to be ground; and (k) first, second and third micrometer means respectively associated with said first, second and third plates for controlling the positions of said first, second and third plates, whereby the orientation of said microscope with respect to said grinding wheel and optical fibre mounting means can be controlled by a user.

2. A grinding device as claimed in claim 1, and including micrometer means for controlling the positions of said fibre mounting means relative to said grinding wheel.

3. A grinding device as claimed in claim 2, and including means for illuminating the end of a fibre being ground.

4. A grinding device as claimed in claim 3, wherein the angle of said grinding wheel is adjustable.

* * * * *